United States Patent [19]

Corkran et al.

[11] Patent Number: 4,636,778

[45] Date of Patent: Jan. 13, 1987

[54] BRUSH WEAR MONITOR

[75] Inventors: William M. Corkran, University Heights; Herbert A. Koeth, Mentor-on-the-Lake; L. James Pugsley, Rocky River, all of Ohio

[73] Assignee: Reliance Electric Company, Cleveland, Ohio

[21] Appl. No.: 538,181

[22] Filed: Oct. 3, 1983

[51] Int. Cl.[4] ..... G08B 21/00

[52] U.S. Cl. ..... 340/648; 340/691; 340/635; 340/679; 200/61.41; 310/245

[58] Field of Search ..... 340/648, 679, 691, 635, 340/641, 642; 200/61.40, 61.41; 310/242, 245, 247, 251, 252

[56] References Cited

U.S. PATENT DOCUMENTS

| | | | |
|---|---|---|---|
| 2,762,035 | 9/1956 | Triman | 340/540 |
| 3,409,873 | 11/1968 | Duffy | 340/642 X |
| 3,452,347 | 6/1969 | Stimson | 340/691 X |
| 3,523,288 | 8/1970 | Thompson | 340/648 |
| 4,169,357 | 10/1979 | Kelley | 340/654 |
| 4,333,095 | 6/1982 | Silva | 340/648 |
| 4,344,009 | 8/1982 | Reynolds | 310/242 |
| 4,390,870 | 6/1983 | Michael | 340/648 |

*Primary Examiner*—James L. Rowland
*Assistant Examiner*—Jeffery A. Hofsass
*Attorney, Agent, or Firm*—Roy F. Hollander

[57] ABSTRACT

A brush wear monitor system for dynamoelectric machines includes a sensor imbedded in a brush to provide a signal indicating a predetermined amount of brush wear. The brush wear signal is provided through an isolation network to an indicator circuit. The indicator circuit includes a first indicating lamp which is illuminated in the absence of a signal from the brush wear sensor to indicate normal operation and a second indicator lamp which is illuminated only in response to receipt of a brush wear signal from the sensor. Upon receipt of a signal the first indicator lamp is extinguished and the second indicator lamp is illuminated. A manually operated test switch is provided to check the operation of the indicator circuit.

3 Claims, 5 Drawing Figures

BRUSH WEAR MONITOR

BACKGROUND ART

This invention relates to brush wear monitors for dynamoelectric machines and more particularly to a brush wear monitor having an improved arrangement for indicating the wear status of brushes.

Brushes are employed in DC motors and generators to transfer electric current between stationary machine components and a rotating commmutator. The commutator is constructed of copper, a relatively soft metal. The brushes must be constructed of material which will itself wear as a result of contact with the rotating commutator, rather than causing wear of the commutator. Typically, brushes are made of combinations of carbon, graphite and perhaps a small amount of metal. Although brush wear is necessary, brushes must not be allowed to wear down completely or damage to the motor or generator may result. To avoid this problem, industrial users of dynamoelectric machines first employed inspection schedules to discover and replace excessively worn brushes. Brush wear monitoring systems have also been employed and usually permit less frequent inspections without increasing the risk of complete brush failure.

A brush wear monitor system of particular advantage is disclosed in U.S. Pat. No. 4,333,095 assigned to the Assignee of the present invention. The brush wear monitor system described in U.S. Pat. No. 4,333,095 includes an indicator for receiving a "short brush" signal and providing a visual warning of the condition. The commercial embodiment of the monitor system included a warning light which was illuminated when the "short brush" signal was received, and further included a manual push button test feature which allowed a user to test the operation of the warning light. This system was subject to certain disadvantages, however, in that if the warning light or monitor system failed, or if the power input to the monitor system was disrupted, the user would receive no warning of excessive brush wear and would have no notice of failure without periodically performing a manual check.

Another brush wear monitor system on the market includes a pair of lights, one to indicate "normal" operation and the other to indicate excessive brush wear. There is no checking feature, however, to detect a failure of the warning light so that a "short brush" signal could be overlooked.

DISCLOSURE OF THE INVENTION

The present invention provides an improved brush wear monitoring system which substantially eliminates the disadvantages described above encountered in prior systems.

According to the present invention, there is provided a system for monitoring brush wear in dynamoelectric machines including a brush having sensor means for providing an electrical signal indicating a predetermined amount of brush wear, first indicator means for positively indicating the absence of a signal from the sensor means and second indicator means for indicating the receipt of a signal from the sensor means. Means is provided responsive to a signal from the sensor means for terminating the signal absence indication and activating the signal presence indication, along with means for simulating the receipt of a signal from the sensor means to test the operation of the first and second indicator means.

Thus, a monitor system according to the present invention provides a positive indication of normal brush wear, a positive indication of excessive brush wear and a means for quickly checking the operation of the indicators.

BEST MODE FOR CARRYING OUT THE INVENTION

Figure 1:
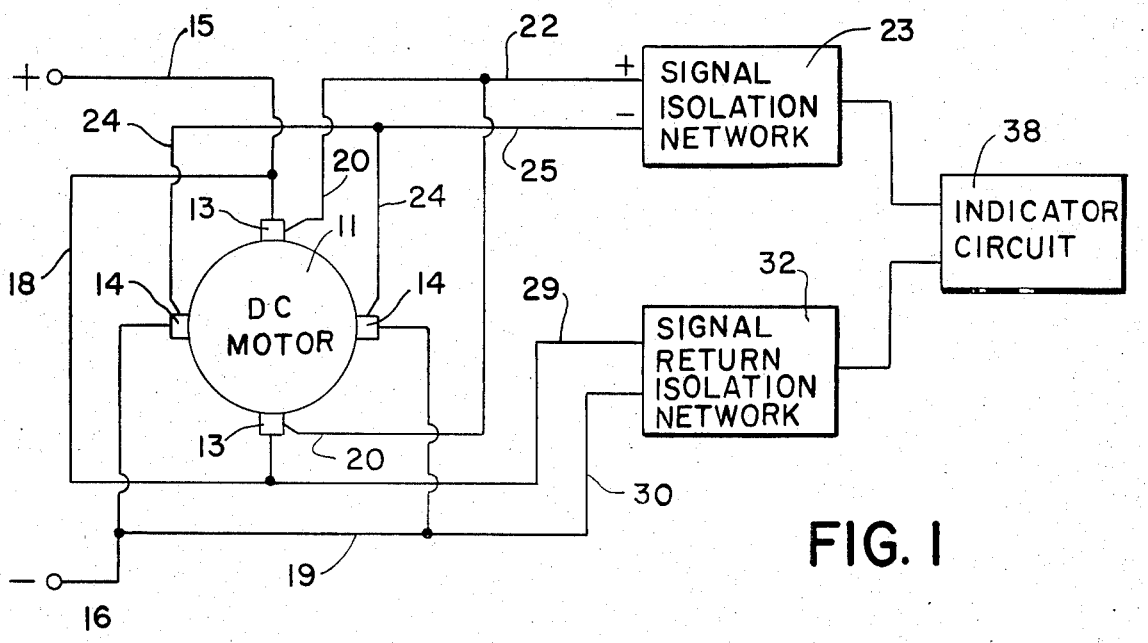
FIG. 1 is a block diagram of a brush wear monitoring system according to the present invention connected to a dynamoelectric machine.

Referring now to the drawing, FIG. 1 shows a brush wear monitoring system according to the present invention monitoring the brushes in a dynamoelectric machine. In this illustrative example, the dynamoelectric machine is shown as a four pole DC motor 11 having brushes 13, 14 connected across power lines 15 and 16. The diametrically opposite pairs of brushes 13, 14 are connected in parallel by means of jumpers 18 and 19. At least one brush in each of the two sets of brushes 13,14 is constructed with a brush wear sensor to provide a signal indicating a predetermined amount of brush wear as described in U.S. Pat. No. 4,333,095 which is incorporated herein by reference and made a part hereof. The leads 20 for the sensors of brushes 13 are connected together and through line 22 to a signal isolation network 23. The leads 24 for the sensors of brushes 14 are connected together and to signal isolation network 23 through line 25. Similarly, the respective signal return lines 29 and 30 connect the two sets of parallel connected brushes 13, 14 to a signal return isolation network 32. The output from signal isolation network 23 and signal return isolation network 32 are connected to an indicator circuit 38.

Figure 2:
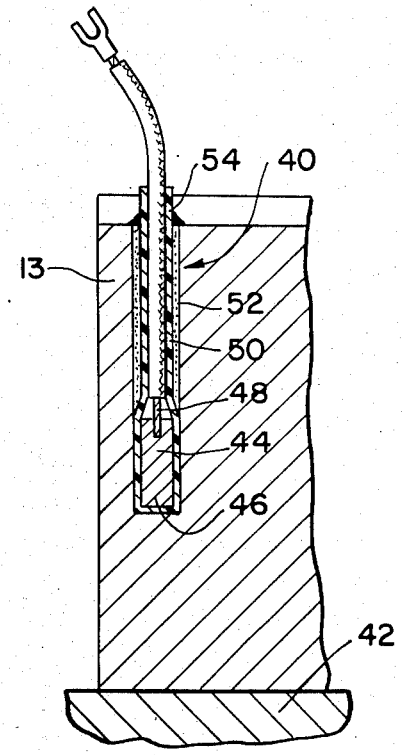
FIG. 2 is a sectional view through a brush holder and brush illustrating a brush wear sensor which may be used in the present invention.

FIG. 2 shows a portion of one of the motor brushes 13,14, identified as one of brushes 13 in this example, which has sensor 40 imbedded therein in accordance with U.S. Pat. No. 4,333,095. The end of brush 13 is shown in contact with the surface of commutator 42 of motor 11. Sensor 40 includes a miniature cylindrical brush 44 of carbonaceous material. The inner end 46 of miniature brush 44 constitutes a contact which, after a predetermined amount of brush wear has occured, makes contact with the surface of commutator 42. An insulated copper conductor 48 is imbedded into miniature brush 44 and is connected at its other end to lead 20 (FIG. 1). An insulating sleeve 50 covers both conductor 48 and brush 44. Sleeve 50 isolates the conductive surface of the miniature brush from current flow in brush 13 until the end 46 of the miniature brush 44 engages the surface of commutator 42. The portion of sleeve 50 covering end 46 of the miniature brush is quickly worn away upon contact with commentator 42.

The entire sensor assembly 40 is inserted into a hole 52 drilled in brush 13 to a statistically determined depth so that a safe period of brush wear remains after a signal is provided as a result of contact between end 46 of miniature brush 44 and the surface of commutator 42. The sensor assembly 40 is held in place in hole 52 by cement 54 at the entrance to the hole. In operation, sufficient brush wear produces contact between the end surface 46 of miniature brush 44 and the surface of commutator 42. As a result, a signal is provided through conductor 48 to lead 20 (FIG. 1) and signal isolation network 23.

Figure 3:
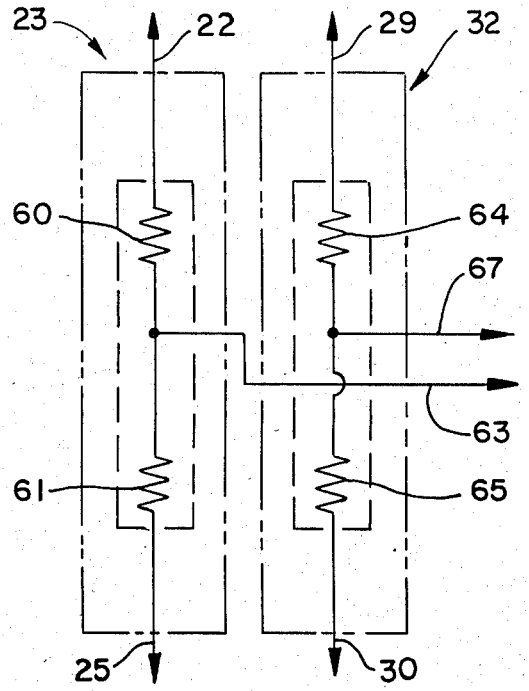
FIG. 3 is a diagram of brush wear signal isolation networks which may be used in the present invention.

As shown in FIG. 3, each of the signal isolation network 23 and the signal return isolation network 32 comprises a pair of series resistors, identified as 60,61 for network 23 and 64, 65 for network 32. As shown, resistor 60 is connected through line 22 and leads 20 (FIG. 1) to the sensors for brushes 13 and resistor 61 is connected through line 25 and leads 24 to the sensors for brushes 14 of motor 11. The common point between series resistors 60, 61 is connected to indicator circuit 38 through line 63. Series resistors 64, 65 of signal return isolation network 32 are connected across the armature voltage of motor 11 with the common point between the resistors connected to indicator circuit 38 through line 67. There is no signal current through the isolating resistors in the isolation networks to indicator 38 unless and until one of the sensor brushes 44 (FIG. 2) has contacted the commutator surface. When that occurs, the isolation network resistors limit the current and the sensor signal level to indicator circuit 38 to a low and safe value but ample for operating indicating circuit 38. Resistors 60,61 also isolate the sensors of brushes 13 from the sensors of brushes 14.

Figure 4:
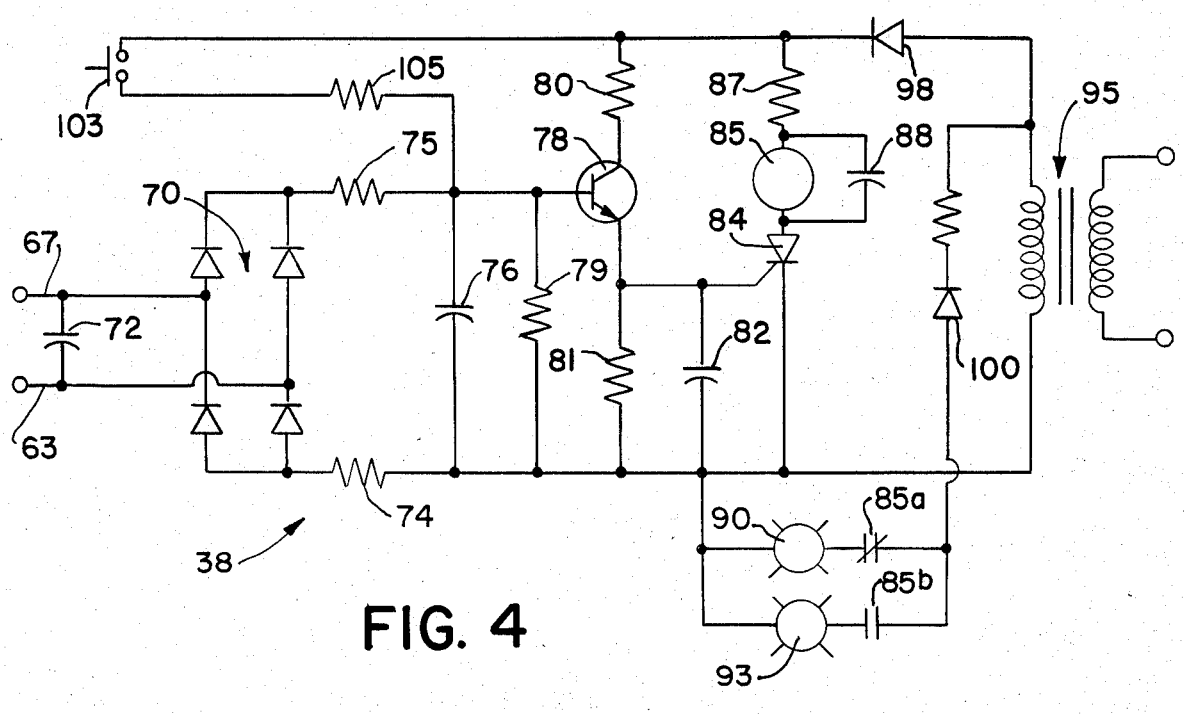
FIG. 4 is a schematic diagram of the indicator circuit of the present invention.

Referring now to FIG. 4, indicator circuit 38 includes a full wave rectifier 70 which has lines 63 and 67 from the outputs of isolation networks 23 and 32 connected to its input. A filter capacitor 72 is connected across the input lines to rectifier 70 to bypass any high frequency noise that might otherwise tend to activate the indicator circuit. The output of rectifier 70 is connected to an integrating circuit including resistors 74,75 and capacitor 76. The output of the integrating circuit is connected to the base of transistor 78. Transistor 78 is connected to base and collector resistors 79, 80, respectively, and to emitter resistor 81 and capacitor 82. The emitter of transistor 78 is connected to the gate of a controlled rectifier 84. The coil of a relay 85 is connected in series with the anode of controlled rectifier 84 and a resistor 87. A capacitor 88 is connected across the relay coil.

Relay 85 has a set of normally closed contacts **85*a* and a set of normally open contacts 85*b*. Contacts 85*a* are connected in series with a "normal" indicator lamp 90 while contacts 85*b* are connected in series with a "warning" indicator lamp 93. Power is supplied to the indicator circuit through a transformer 95 from a suitable AC source. A diode 98 connected in series with the secondary of transformer 95 rectifies the alternating current for transistor 78 and controlled rectifier 84. A second diode 100 also connnected to the secondary of transformer 95 provides rectified power to lamps 90 and 93**.

A manually operated normally open test switch 103 and a resistor 105 are connected between diode 98 and the base of transistor 78. Switch 103, when operated, provides a positive signal to transistor 78 simulating a "short brush" signal from signal isolation network 23.

In operation, so long as none of the brushes 13, 14 have worn to the point where miniature brush 44 (FIG. 2) contacts the surface of commutator 42 no "short brush" signal is provided to indicator circuit 38. Transistor 78 and controlled rectifier 84 are not conductive and relay 85 is not energized. Normal indicator lamp 90 is energized and provides a positive indication that brush wear on motor 11 has not yet reached the warning point. Any noise or false "short brush" signals will be of short duration and prevented from triggering controlled rectifier 84 by the action of capacitors 72, 76 and 82. Indicator circuit operation can be tested periodically by depressing test switch 103 which turns on transistor 78 and controlled rectifier 84 causing relay 85 to operate, normal lamp 90 to be extinguished, and warning lamp 93 to be energized. If the expected actions do not occur, remedial action can be taken to ensure that the indicator circuit will operate properly when a "short brush" signal is received.

A "short brush" signal appearing at the input of rectifier 70 is fed to integrating capacitor 76 and, if of sufficient duration to charge capacitor 76, turns on transistor 78. The time constant of the integrating circuit including capacitor 76 is such that a spurious or intermittant brush sensor signal will not charge capacitor 76 sufficiently to turn on transistor 78. When transistor 78 is rendered conductive it permits charging of capacitor 82. After the charging delay, the signal at the emitter of transistor 78 is provided to the gate of controlled rectifier 84 which is turned on. After a delay determined by resistor 87 and capacitor 88, relay 85 is operated. Contacts **85*a* are then opened and contacts 85*b* closed to extinguish normal lamp 90 and energize warning lamp 93**.

Figure 5:
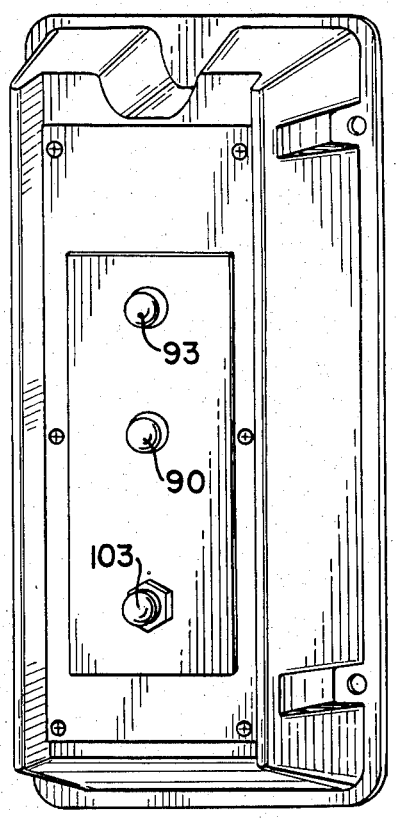
FIG. 5 is a perspective view of an enclosure for the indicator circuit of the present invention.

FIG. 5 shows an exemplary form of enclosure for indicator circuit 38 with normal lamp 90, warning lamp 93, and test button 103 conveniently arranged thereon. One quick glance at lamp 90 confirms that the monitor system is functioning properly and that no "short brush" signal has been received by the indicator circuit. Proper operation of the monitor system itself can be determined quickly and easily by depressing button 103. Too, the absence of a normal operating indication from lamp 90 is quickly noticable so that remedial action can be taken to restore the monitoring system to proper operation.

What is claimed is:

1. A system for monitoring brush wear in dynamoelectric machines comprising a brush having sensor means for providing electrical signals indicating a predetermined amount of brush wear, power supply means separate from said electrical signals from said sensor means, first indicator means, first switch means for connecting said first indicator means to said power supply means in the absence of a signal from said sensor means, second indicator means, second switch means for maintaining said second indicator means disconnected from said power supply means in the absence of a signal from said sensor means, means responsive to a signal from said sensor means for actuating said first and second switch means, and means connected to said power supply means for providing a signal to said signal responsive means to simulate the receipt of a signal from said sensor means to test the operation of said first and second indicator means, said first and second switch means and said signal responsive means.

2. A system as claimed in claim 1 wherein said signal responsive means includes a relay having a normally closed contact in series with said first indicator means and a normally open contact in series with said second indicator means, and switching means for energizing said relay in response to a signal from said sensor means.

3. A system as claimed in claim 1 wherein said simulating means includes switch means for providing an electrical signal simulating a signal from said sensor means to said signal responsive means.

* * * * *